United States Patent [19]

Deutsch

[11] Patent Number: 4,497,073

[45] Date of Patent: Feb. 5, 1985

[54] LACROSSE GLOVE

[76] Inventor: Warren D. Deutsch, 33 Mill Dam Rd., Smithtown, N.Y. 11787

[21] Appl. No.: 508,866

[22] Filed: Jun. 29, 1983

[51] Int. Cl.[3] ..... A41D 13/08; A41D 19/00

[52] U.S. Cl. ..... 2/161 A; 2/16; 2/20; 2/162

[58] Field of Search ..... 2/161 A, 161 R, 162, 2/158, 159, 16, 18, 20

[56] References Cited

U.S. PATENT DOCUMENTS

| | | | |
|---|---|---|---|
| 404,929 | 6/1889 | O'Sullivan | 2/18 |
| 1,598,718 | 9/1926 | Healy | 2/18 |
| 2,394,136 | 2/1946 | Bakke | 2/16 X |
| 3,605,117 | 10/1971 | Latina | 2/16 |

*Primary Examiner*—Werner H. Schroeder
*Assistant Examiner*—J. L. Kravitz
*Attorney, Agent, or Firm*—Marion C. Staves

[57] ABSTRACT

An improved lacrosse glove having a hand receiving portion and a cuff or gauntlet connected by a novel flexible connecting means comprising a padded portion attached at one edge to the inside of the hand receiving portion and at the other edge to an elastic portion which is in turn attached to the inside of the cuff. The padded portion provides protection in the opening between the hand receiving portion and the cuff, while the elastic portion, which is inside the cuff, provides flexibility and maximum motion in the area of the user's wrist.

3 Claims, 3 Drawing Figures

LACROSSE GLOVE

FIELD OF INVENTION

This invention relates to an improved lacrosse glove. More particularly this invention relates to an improved lacrosse glove having a novel connecting means between the hand receiving portion and the cuff portion or gauntlet providing flexibility and protection.

BACKGROUND OF THE INVENTION

Lacrosse is a game which has been played for many hundreds of years. The game is scored by attempting to put a ball into the goal of the opposing team. The ball, of a hard elastomeric composition, is carried and tossed or thrown from a stick.

By its nature lacrosse is a rough sport which generally requires certain protective equipment for those who participate in the sport. The hands are particularly vulnerable since players in "checking", i.e. trying to knock the ball out of the lacrosse stick, often hit the person carrying the ball in the hands. For this reason, lacrosse players generally wear padded gloves with padded hand receiving and cuff portions to protect the hands and lower forearms. In the past the hand receiving and cuff portions have been laced together as shown in Brine's U.S. design Pat. No. De. 257,909. Such gloves do provide protection for the user but limit his hand motion and flexibility.

OBJECTS AND GENERAL DESCRIPTION OF THE INVENTION

One object of this invention is to provide a glove in which the hand receiving portion and cuff portion can move separately, thus providing maximum motion and flexibility in the area of the user's wrist. Another object of this invention is to provide protection in the opening between the hand receiving portion and the cuff portion.

It has now been found that the aforesaid objects can be obtained by using a novel connecting means to connect the hand receiving portion to the cuff portion, said connecting means comprising a padded portion attached at one edge to the inside of the hand receiving portion and at the other edge to an elastic portion which is in turn attached to the inside of the cuff portion. Thus, the padded portion provides protection in the opening between the hand receiving portion and the cuff portion and at the same time the elastic portion, which is inside the cuff, provides motion and flexibility between the hand receiving portion and cuff portion.

It will be obvious from the description below that to prevent the hand receiving portion from interfering with the motion of the cuff portion it may be desirable to maintain at least a small opening between the upper edge of the hand receiving portion and the lower edge of the cuff portion. However, the user's wrist exposed by this opening must be protected from injury. The flexible connecting means of this invention can provide such protection without impairing motion or flexibility.

According to one embodiment of the invention the flexible connecting means consists of a continuous padded portion covering the back and sides of the wrist and attached to a continuous elastic portion; the padded portion being securely attached along its lower horizontal edge to the inside of the hand receiving portion, at its upper horizontal edge to the lower horizontal edge of the elastic portion and the upper horizontal edge of the elastic portion being securely attached to the inside of the cuff portion.

It has been found that maximum motion and flexibility is also provided when the flexible connecting means is positioned only in the opening on the side of the hand above the thumb. The back of the hand being protected by padding underlying the opening and sewn at one edge to the hand receiving portion and at the other edge to the cuff portion. Thus, according to another embodiment of the invention, the flexible connecting means consists of a padded portion protecting the side of the hand above the thumb, which is attached at its lower horizontal edge to the inside of the hand receiving portion. The upper horizontal edge of the padded portion reaches under the cuff where it is securely attached to the lower horizontal edge of an elastic portion which is in turn attached along its upper horizontal edge to the inside of the cuff portion. The back of the hand is protected by a padding portion underlying the opening between the edge of the hand receiving portion and the lower edge of the cuff portion and securely attached at its lower horizontal edge to the inside of the hand receiving portion and at its upper horizontal edge to the inside of the cuff portion.

DRAWINGS AND DETAILED DESCRIPTION

Figure 1:
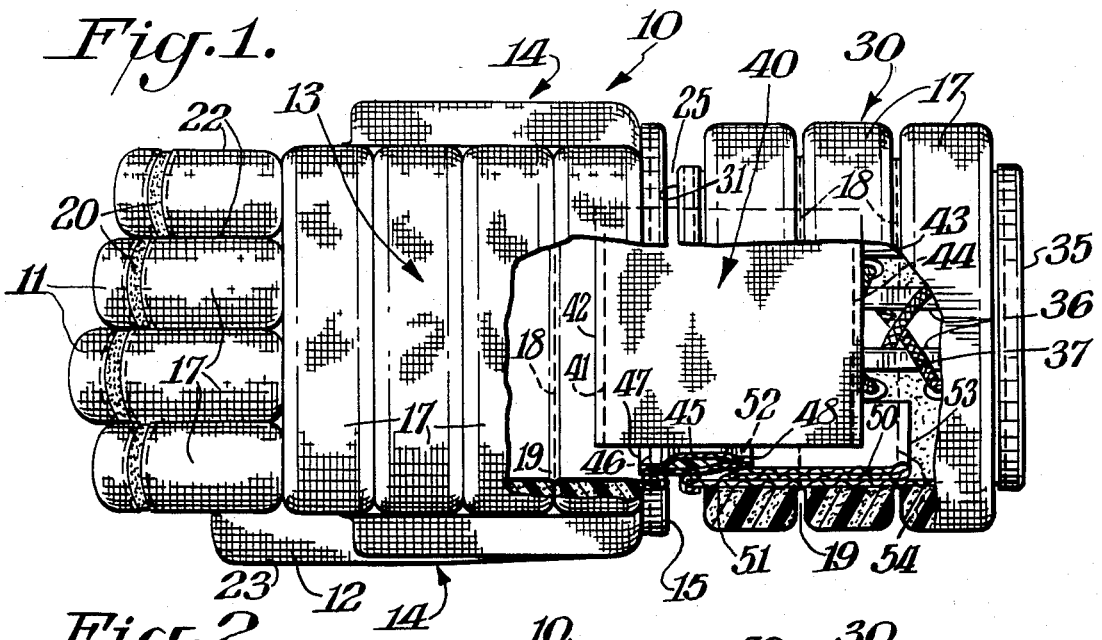
FIG. 1 is a top view of the back of a lacrosse glove, certain portions thereof being cut away to show one embodiment of this invention.

Referring to FIG. 1, there is shown a top view of a lacrosse glove including the improvement of this invention. The hand receiving portion (10) is adapted to receive the user's hand and to substantially envelope the hand from the ends of the fingers (11) and thumb (12) to the edge (15) of the hand receiving portion (10), which horizontally encircles the wrist of the user. The hand receiving portion (10) includes padding means overlying and securely attached to the back (13) and sides (14) of the hand receiving portion (10) and extending uninterrupted from the ends of the fingers (11) and thumb (12) to the edge (15) encircling the user's wrist. The padding means is formed of padding rolls (17), which are positioned horizontally across the back (13) of the hand receiving portion (10) and vertically along the finger stalls (22), thumb stall (23) and sides (14) of the hand receiving portion (10). Each padding roll (17) is securely attached to the hand receiving portion (10) by stitching (18) around the base (19) of each roll. About half way down each padding roll (17), protecting the finger stalls (22), is a horizontal slit, spread apart, and a spreader ply (20) stitched across the spread apart margins formed by the slit so that a bend is imparted to the finger stalls (22).

The cuff portion (30) extends generally around the lower part of the user's forearm and has a lower horizontal edge (31) adjacent the user's wrist, an upper horizontal edge (35) defining the upper extent of the cuff portion (30) around the user's forearm and two vertical edges (36) (shown in the cut away area) adjacent the inside of the user's forearm, adjustably connected with removable lacings (37) (shown in the cut away area). The cuff portion (30) includes padding means overlying and securely attached to essentially the entire outer surface of the cuff portion (30). The padding means is formed of padding rolls (17), which are positioned horizontally around the cuff portion (30). Each padding roll (17) is securely attached to the cuff portion (30) by stitching (18) around the base (19) of each roll.

The connecting means attaching the hand receiving portion (10) to the cuff portion (30) consists of a padding portion and a flexible connecting means (shown in the cut away area). The padding portion (40) underlying the opening (25), protects the back of the wrist and is securely attached to the inside of the hand receiving portion (10) below the edge (15) by stitching (41) along the lower horizontal edge (42) of said padding portion (40). The upper horizontal edge (43) of said padding portion (40) is securely attached to the inside of the cuff portion (30) generally on a line horizontally between the lower and upper horizontal edges (31 and 35) of the cuff portion (30) by stitching (44). The padded portion (45) (shown in cross section in the cut away area) protects the side of the wrist above the thumb and is securely attached to the inside of the hand receiving portion (10) below edge (15) by stitching (46) along the lower horizontal edge (47) of said padded portion (45). The upper horizontal edge (48) underlying the lower horizontal edge (31) of the cuff portion (30) is securely attached to the lower horizontal edge (51) of the elastic portion (50) by stitching (52). The upper horizontal edge (53) of the elastic portion (50) is securely attached to the inside of the cuff portion (30) generally on a line horizontally between the lower and upper horizontal edges (31 and 35) of the cuff portion (30) by stitching (54). The padded portion (45) and the elastic portion (50) comprise the flexible connecting means.

Figure 2:
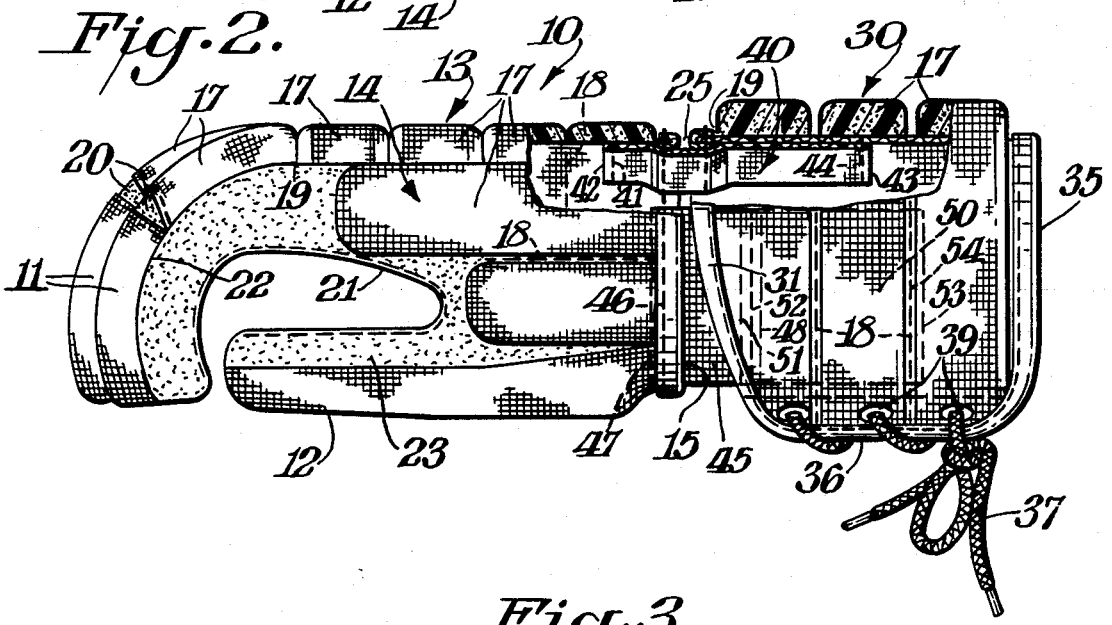
FIG. 2 is a side elevation of the glove of FIG. 1, certain portions thereof being cut away for better illustration.

Referring to FIG. 2, there is shown a side elevation of the lacrosse glove of FIG. 1, including the improvement of this invention. The hand receiving portion (10) is adapted to receive the user's hand and to substantially envelope the hand from the ends of the fingers (11) and thumb (12) to the edge (15) of the hand receiving portion (10), which horizontally encircles the wrist of the user. The hand receiving portion (10) includes a palm area (21) which envelopes the hand proper of the user, finger stalls (22) which open into the palm area (21) and receive the user's fingers, a thumb stall (23) which opens into the palm area (21) and receives the user's thumb, and padding means overlying and securely attached to the back (13) and sides (14) of the hand receiving portion (10) and extending uninterrupted from the ends of the fingers (11) and thumb (12) to the edge (15) encircling the user's wrist. The padding means is formed of padding rolls (17) which are positioned horizontally across the back (13) of the hand receiving portion (10) and vertically along the finger stalls (22), thumb stall (23) and sides (14) of the hand receiving portion (10) by stitching (18) around the base (19) of each roll. About half way down each padding roll (17) protecting the finger stalls (22) is a horizontal slit, spread apart and a spreader ply (20) stitched across the spread apart margins formed by the split so that a bend is imparted to the finger stalls (22).

The cuff portion (30) extends generally around the lower part of the user's forearm and has a lower horizontal edge (31) adjacent the user's wrist, an upper horizontal edge (35) defining the upper extent of the cuff portion (30) around the user's forearm and two vertical edges (36) (only one shown) adjacent the inside of the user's forearm adjustably connected with removable lacings (37) laced through a plurality of vertically spaced grommets (39). The cuff portion (30) includes padding means overlying and securely attached to essentially the entire outer surface of the cuff portion (30). The padding means is formed of padding rolls (17) which are positioned horizontally around the cuff portion (30). Each padding roll (17) is securely attached to the cuff portion (30) by stitching (18) around the base (19) if each roll.

The connecting means attaching the hand receiving portion (10) to the cuff portion (30) consists of a padding portion (which is shown in the cut away area) and a flexible connecting means. The padding portion (40) (shown in the cut away area) underlying the opening (25) protects the back of the wrist and is securely attached to the inside of the hand receiving portion below the edge (15) by stitching (41) along the lower horizontal edge (42) of said padding portion (40). The upper horizontal edge (43) of said padding portion (40) is securely attached to the inside of the cuff portion (30) generally on a line horizontally between the lower and upper horizontal edges (31 and 35) of the cuff portion (30) by stitching (44). The padded portion (45) (shown in the opening between edge 15 of the hand receiving portion and edge 31 of the cuff portion) protects the side of the wrist above the thumb and is securely attached to the inside of the hand receiving portion (10) below edge (15) by stitching (46) along the lower horizontal edge (47) of the said padded portion (45). The upper horizontal edge (48) of the said padded portion (45) underlying the lower horizontal edge (31) of the cuff portion (30) is securely attached to the lower horizontal edge (51) of the elastic portion (50) by stitching (52). The upper horizontal edge (53) of the elastic portion (50) is securely attached to the inside of the cuff portion (30) generally on a line horizontally between the lower and upper horizontal edges (31 and 35) of the cuff portion (30) by stitching (54). The padded portion (45) and the elastic portion (50) comprise the flexible connecting means.

Figure 3:
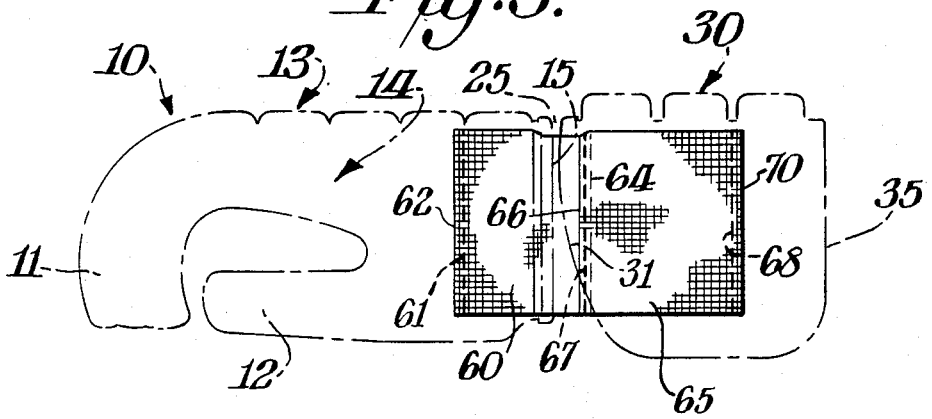
FIG. 3 is a phantom outline of the side of a lacrosse glove, showing another embodiment of this invention in solid lines.

Referring to FIG. 3, there is shown a phantom outline of the side of a lacrosse glove, showing another embodiment of the invention in solid lines. The hand receiving portion (10) and cuff portion (30) are shown in outline. The flexible connecting means (shown in solid lines) attaching the hand receiving portion (10) to the cuff portion (30) comprises a padded portion (60) underlying the opening (25) adjacent the wrist of the user between the edge (15) of the hand receiving portion (10) and the lower horizontal edge (31) of the cuff portion (30). The padded portion (60) extends from one side of the user's wrist to the other side (14) (only one side shown in the phantom outline) and protects both sides (14) and the back (13) of the wrist. The padded portion is securely attached to the inside of the hand receiving portion below the edge (15) by stitching (61) along the lower horizontal edge (62) of said padded portion (60). The upper horizontal edge (64) of the padded portion (60) underlying the lower horizontal edge (31) of the cuff portion (30) is securely attached to the lower horizontal edge (66) of the elastic portion (65) by stitching (67). The elastic portion (65) extends from one side (14) of the user's wrist to the other side (14) (only one side shown in the phantom outline). The upper horizontal edge (70) of the elastic portion (65) is securely attached to the inside of the cuff portion (30)

generally on a line horizontally between the lower and upper horizontal edges 31 and 35 of the cuff portion (30) by stitching (68).

It will be obvious to those skilled in the art that still other embodiments are within the scope of this invention. For example, a glove with flexible connecting means protecting only the side of the hand above the thumb and the back of the hand is contemplated by this invention.

The shell of the lacrosse glove of this invention may be constructed of any scuff and tear resistant material normally used in the construction of such gloves. Such materials include for example leather, knit or woven nylon, dacron, cotton, etc. It may be desirable to construct various sections of the glove from different materials. For example, the palm and inner surface of the finger stalls may be constructed of leather while the covering for the padding rolls may be constructed of knit nylon. The filling for the padding rolls may be of any material which will cushion the impact of blows and return to its original shape. It may be desirable to place net or mesh inserts on the sides of the finger stalls between the fingers to provide cooling by the circulation of air. The elastic portion of the connecting means, which provides flexibility and motion, can be constructed of any elastic material with sufficient strength and elasticity. Typical elastic materials which may be used in the gloves of this invention are braided or woven elastic materials or elastic webbing such as spandex or Lycra. TM Other features, advantages and specific embodiments of this invention will be readily apparent to those skilled in the art upon reading the foregoing disclosure. These modifications and others, being within the ability of one skilled in the art, are within the spirit of this invention and the scope of the appended claims.

What I claim is:

1. A lacrosse glove comprising:

(1) a hand receiving portion adapted to receive the user's hand and to substantially envelope the hand from the ends of the fingers and thumb to the edge of said hand receiving portion horizontally encircling the wrist of the user, the hand receiving portion including a palm area which envelopes the hand proper of the user, finger stalls which open into the palm area and receive the user's fingers, a thumb stall which opens into the palm area and receives the user's thumb, and padding means overlying and securely attached to the back and sides of the hand receiving portion and extending uninterrupted from the ends of the fingers and thumb to the edge encircling the user's wrist;

(2) a cuff portion extending generally around at least the lower part of the user's forearm, having a lower horizontal edge adjacent the user's wrist, an upper horizontal edge defining the upper extent of the cuff portion around the user's forearm and two vertical edges adjacent the inside of the user's forearm adjustably connected with removable lacings, padding means overlying and securely attached to essentially the entire outer surface of the cuff portion; and (3) a flexible connecting means attaching the hand portion to the cuff portion, said flexible connecting means comprising:

a padded portion underlying the opening adjacent the wrist of the user and protecting the wrist area between the edge of the hand receiving portion and the lower horizontal edge of the cuff portion, said padded portion having a lower horizontal edge securely attached to the inside of the hand receiving portion below the edge of the hand receiving portion encircling the wrist and an upper horizontal edge underlying the cuff portion adjacent its lower horizontal edge, said upper horizontal edge being securely attached to the lower horizontal edge of an elastic portion having an upper horizontal edge securely attached to the inside of the cuff portion generally on a line horizontally between the lower and upper horizontal edges of the cuff portion.

2. The lacrosse glove of claim 1 wherein the said flexible connecting means comprises a padded portion and an elastic portion substantially encircling the sides and back of the wrist of the user.

3. The lacrosse glove of claim 1 wherein the said flexible connecting means comprises a padded portion securely attached to an elastic portion, said padded portion underlying the opening between the edge of the hand receiving portion and the lower horizontal edge of the cuff above the thumb of the user and the back of the hand being protected by a padding portion underlying the opening above the back of the wrist between the edge of the hand receiving portion and the lower horizontal edge of the cuff, said padding portion being securely attached at its lower edge to the hand receiving portion and at its upper edge to the cuff portion.

* * * * *